US005152620A

United States Patent [19]

Gomoll et al.

[11] Patent Number: 5,152,620

[45] Date of Patent: Oct. 6, 1992

[54] MATRIX PRINTER EMPLOYING A MATRIX PRINT HEAD ON A MOVABLE SLIDER HAVING SOUND INSULATING MATERIAL

[75] Inventors: Günter Gomoll, Nersingen/Leibi; Wolfgang Hauslaib, Langenau, both of Fed. Rep. of Germany

[73] Assignee: Mannesmann Aktiengesellschaft, Düsseldorf, Fed. Rep. of Germany

[21] Appl. No.: 625,545

[22] Filed: Dec. 11, 1990

[30] Foreign Application Priority Data

Dec. 13, 1989 [DE] Fed. Rep. of Germany ..... 3941598

[51] Int. Cl.[5] ..... B41J 2/235

[52] U.S. Cl. ..... 400/124; 400/175; 400/690

[58] Field of Search ..... 400/124, 689, 690, 124 TC, 400/175, 320

[56] References Cited

U.S. PATENT DOCUMENTS

| | | | |
|---|---|---|---|
| 4,410,288 | 10/1983 | Holmes, Jr. | 400/175 |
| 4,576,496 | 3/1986 | Schwarz et al. | 400/320 |
| 4,643,597 | 2/1987 | Matsui et al. | 400/124 |
| 4,708,502 | 11/1987 | Murakami | 400/124 |
| 4,818,133 | 4/1989 | Williams et al. | 400/124 |

FOREIGN PATENT DOCUMENTS

| | | | |
|---|---|---|---|
| 8009489 | 4/1980 | Fed. Rep. of Germany . | |
| 0209176 | 11/1984 | Japan | 400/689 |
| 0018380 | 1/1985 | Japan | 400/689 |
| 0178078 | 9/1985 | Japan | 400/689 |
| 1035262 | 2/1986 | Japan | 400/689 |
| 0217260 | 9/1986 | Japan | 400/689 |
| 0073981 | 4/1987 | Japan | 400/689 |
| 0122775 | 6/1987 | Japan | 400/124 G |
| 0212182 | 9/1987 | Japan | 400/689 |

*Primary Examiner*—Edgar S. Burr
*Assistant Examiner*—John S. Hilten
*Attorney, Agent, or Firm*—Horst M. Kasper

[57] ABSTRACT

A matrix printer is furnished with a matrix print head (1) supported on a back and forth movable slider (2), guided on a rail guide (3), wherein the print elements (4) can be operated at a high frequency. A matrix print head (1), disposed fixedly in its position relative to the slider (2), is furnished at least at one reference face (8) between the matrix print head (1) and the slider (2) with a sound-insulating layer (10) of an elastic material, and where the matrix print head (1) and the slider (2) can be braced and/or clamped to each other in this region. This construction opposes a sound formation and sound propagation via the print head, the slider (2) and the rail guide (3) by body sound conduction onto frame parts of the printer by employing sound-insulation and sound absorption.

20 Claims, 2 Drawing Sheets

MATRIX PRINTER EMPLOYING A MATRIX PRINT HEAD ON A MOVABLE SLIDER HAVING SOUND INSULATING MATERIAL

BACKGROUND OF THE INVENTION

1. Field of the Invention

The invention relates to a matrix printer with a matrix print head, in particular with a matrix pin print head, which is supported on a back and forth movable slider guided on a rail guide, wherein the print elements can be operated at a frequency higher than 1000 Hz and wherein the print elements are movable via an inking ribbon against an imprint-receiving substrate resting on a print substrate support.

2. Brief Description of the Background of the Invention Including Prior Art

The matrix print head of such a matrix printer is supported on or, respectively, attached to a slider. The slider is guided on a guide axle support, running parallel to the print substrate support. The guide axle support exhibits a circular cross-section and guides and supports the slider on a sliding support bearing of simple construction. A further axle, running in parallel to the guide axle support, is disposed remote relative to the position of the print substrate support. The guide axle support and the axle are made of metal and are supported in the printer side walls. The length of the guide axle support and the axle determines the possible path for the slider.

The print elements contained in the print head generate vibrations during the printing process based on the pin shooting frequency and further frequencies, or based on the specific kind of a particular textual material or of a graphic print structure. These vibrations excite resonance frequencies in the guide axle support, in the side parts, and in the casing by propagating beyond the print head and by passing through the slider. These vibrations are radiated as air-transmitted sound and form a part of the noise emitted by the printer.

It has been determined by way of measurement that excited resonance frequencies of the guide axle support and of the slider induce and decrease vibrations in the print head in such a way that a real deterioration of the generated print image occurs. Thus, there is present not only one single sound path through the equipment body, starting from the print head elements via the print substrate support, but in addition there is a second (return) sound path through the equipment body running in reverse direction from the print substrate support and print head via the slider through the guide axle support and the axle in each case into the two printer side walls.

In particular, sound can travel from the guide axle support via the slider into the print head.

A sound-damping and simultaneously sound-absorbing print substrate support is taught in the German Printed Patent document DE-3,538,762. The sound damping and sound absorption comprises a metallic print bar, a layer decreasing and absorbing vibrations, and a metallic intermediate layer. On the other hand, the sound attenuation is formed by a frequency-neutralizing insulating layer. The insulating layer is formed in this case by an elastic plastic layer, comprised of a plastic material of the polymer group.

It is in fact possible with this combination of sound absorption, i.e. reduction of the sound excitation in the body of individual parts of the printer, and sound-attenuation, i.e. neutralizing of resonance frequencies of certain individual parts of a printer, to avoid the vibration wave propagation via the print substrate support to the frame parts of the printer. It is however not possible in this way to prevent corresponding vibration waves, which are transmitted in "reverse" direction via the print head as well as the slider and the guide axle support and the axle onto further device groups of the printer. These "reverse" vibration waves also contribute to the noise formation.

SUMMARY OF THE INVENTION

1. Purposes of the Invention

It is an object of the present invention to counteract a sound generation via print head, slider, guide axle support, axle onto the frame parts of the printer and to achieve to a large extent also a sound absorption and a sound insulation.

It is a further object of the invention to decrease the noise emitted by a matrix printer.

It is yet a further object of the invention to provide a simple and reliable attachment mechanism for a print head to a respective slider of a matrix printer.

These and other objects and advantages of the present invention will become evident from the description which follows.

2. Brief Description of the Invention

The present invention provides for a matrix printer. The matrix printer comprises a print substrate support for supporting an imprint-receiving substrate resting on the print substrate support and a back and forth movable slider. A matrix print head, supported by the slider, is fixable in its position relative to the slider. The matrix print head includes print elements. The print elements are movable relative to the direction of the substrate support for impacting an inked ribbon. A rail guide support guides and supports the matrix print head. A sound-insulating layer of an elastic material is furnished to the matrix print head and is placed at least against one outer reference face between the matrix print head and the slider. Clamping means brace and clamp the matrix print head and the slider to each other in the region of the sound-insulating layer.

The print elements can be operated at a frequency higher than 1000 Hz. The matrix print head can be a matrix pin print head. The matrix printer can comprise a print pin guide casing for the matrix print head.

The sound-insulating layer can extend over and can clampingly surround the print pin guide casing of the matrix print head. The sound-insulating layer can be furnished by a single-piece packing body surrounding the print pin guide casing of the matrix print head on at least three sides, including a bottom side, a top side, and a side wall. A spring clamp can clamp the print pin guide casing of the matrix print head onto the slider, and can lockingly grip under recesses of the slider for retaining the matrix print head on the slider in a fixed position. The print pin guide casing can be furnished with a guide mouth piece. The reference face between the matrix print head and the slider can be disposed immediately neighboring at the guide mouth piece of the print pin guide casing.

A packing body can have a planar bottom face and can close with its planar bottom face the print pin guide casing of the matrix print head and can include a cross-sectional hinge region. A support web can be attached to the print pin guide casing. Positioning protrusions can be furnished at the print pin guide casing. The cross-sectional hinge region of the packing body can surround on one side a support web of the print pin guide casing. A packing body part can partially surround a U-cross-section of the print pin guide casing, can cover part of a top side, and can connect to the cross-sectional hinge region of the packing body. Openings can be furnished in the packing body for the positioning protrusions of the matrix print head.

A clamp can lockingly engage the slider and can surround the print pin guide casing for retaining the matrix print head against the slider. The clamp can engage recesses of the slider disposed on two opposite sides relative to the reference face between matrix print head and slider. The clamp can be formed of a spring strip pressing the matrix print head against the slider.

A method for fixedly attaching a matrix print head to a slider comprises the following steps. A back and forth movable slider is guided and supported on a rail guide support. A sound-insulating layer of an elastic material is placed around a matrix print head for positioning via at least one outer reference face between the matrix print head and the slider. An imprint-receiving substrate is placed against a print substrate support. The matrix print head, including movable print elements relative to the direction of the substrate support for impacting an inked ribbon, is clamped together with the sound-insulating layer to the slider with clamping means for fixing the position of the matrix print head relative to the slider by attachment in a region of the sound-insulating layer.

According to the invention, a matrix print head is fixedly disposed in its position relative to a slider. At least one reference face between the matrix print head and the slider is furnished with a sound-insulating layer made of an elastic material. The matrix print head and the slider can be braced with each other and clamped together in this region of the sound-insulating layer. On the one hand, the noise generation, passing along the "second path" from the print head via the slider and rail guide, is counteracted by a decreased sound excitation and, on the other hand, a decrease of the excitation of the resonance frequency is achieved in the subsequently disposed and connected device parts.

The sound insulation can further be improved in that the sound-insulating layer is disposed in the region of a print pin guide casing of the matrix print head.

A further improvement of the sound absorption and of the sound insulation of the printer parts is furthermore achieved in that the sound-insulating layer is formed as part of a single-piece packing body, surrounding the print pin guide casing of the matrix pin print head on at least three sides, including bottom side, upper side, and a side wall.

The bracing and/or clamping of the print head over the packing body with the slider is performed according to further features of the invention such that the print pin guide casing of the matrix pin print head is braced and/or clamped by way of a spring clamp on the slider, where the spring clamp grips under recesses of the slider.

A further improvement of the sound-insulation of slider, print head. and rail guide results where the reference face between matrix print head and slider is disposed immediately neighboring a guide mouth piece of the pin guide casing.

Additional advantages of the packing body and a still more improved air and body sound absorption or, respectively, sound insulation is achieved where the packing body closes the print pin guide casing with the planar bottom surface of a matrix print head furnished with positioning protrusions. Furthermore, a cross-sectional region of the packing body surrounds one side of one of the support webs of the print pin guide casing. A packing body part is connected to the print pin guide casing. The packing body part surrounds in part the U-cross-section of the print pin guide casing and covers the upper side. Openings are furnished for the positioning protrusions of the matrix print head.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
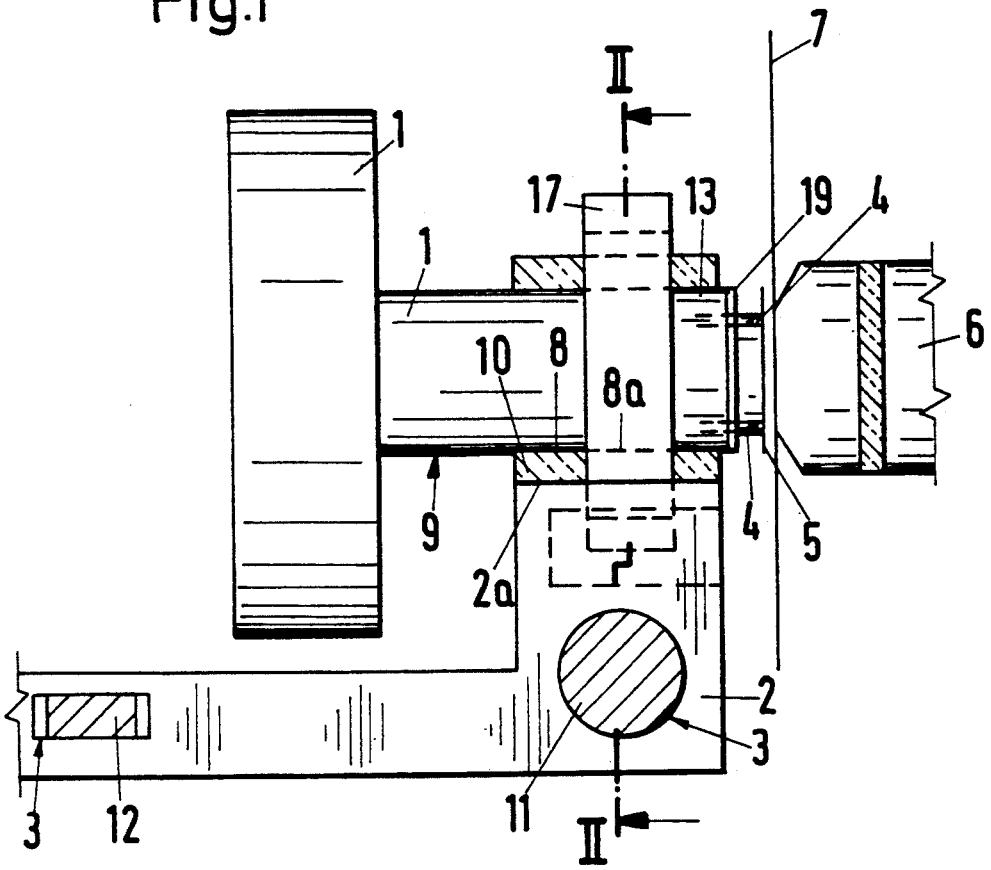
FIG. 1 is a side elevational view of a print head and a slider.

According to the present invention there is provided for a matrix printer with a matrix print head, in particular a matrix pin print head. The matrix print head is supported on a back and forth movable slider. The slider is guided on a rail guide support. The print elements are operated at a frequency higher than 1000 Hz. The print elements are movable against an imprint-receiving substrate resting on a print substrate support via an inking ribbon. The matrix print head 1, fixable in its position relative to the slider 2, is furnished with a sound-insulating layer 10 of an elastic material at least at a reference face 8 between the matrix print head 1 and the slider 2. The matrix print head 1 and the slider 2 are braced and clamped to each other in the region of the sound-insulating layer 10.

The sound-insulating layer 10 can extend over and can clampingly surround a print pin guide casing 13 of the matrix print head 1. The sound-insulating layer 10 can form part of a single-piece packing body 14 surrounding the print pin guide casing 13 of the matrix print head 1 on at least three sides including bottom side 10*a*, top side 10*b*, and side wall 10*c*.

The print pin guide casing 13 of the matrix print head 1 can be clamped onto the slider 2 by way of a spring clamp 17. The spring clamp 17 can grip under recesses 15, 16 of the slider 2.

The reference face 8 between the matrix print head 1 and the slider 2 can be disposed immediately neighboring at a guide mouth piece 19 of the pin guide casing 13.

The packing body 14 can close with its planar bottom face 10*a* the print pin guide casing 13 of the matrix print head 1 furnished with positioning protrusions 20. A cross-sectional hinge region 23 of the packing body 14 can surround on one side a support web 22*a*, 22*b* of the print pin guide casing 13. A packing body part 24 can partially surround the U-cross-section of the print pin guide casing 13, can cover part of the top side 10*b*, and can be connected to the cross-sectional hinge region 23 of the packing body 14. The openings 21 can be furnished for the positioning protrusions 20 of the matrix print head 1.

The matrix printer comprises a matrix print head 1, which is supported in a back and forth movable slider 2. The slider 2 is supported on a rail guide 3. The print elements 4 can be operated at a high frequency such as, for example, over 1000 Hz. The print elements 4 are movable against an imprint-receiving substrate resting on a print substrate support 6 via an inking ribbon 5, where characters or graphics, composed of print dots, are generated.

The matrix print head 1 is fixable in its position relative to the slider 2. For this purpose, there is furnished and employed a reference face 8 between the matrix printer head 1 and the slider 2. The reference face 8 forms a planar face 8*a* at the bottom side 9 of the matrix print head 1. A sound-insulating layer 10, made of an elastic material, is disposed between the planar face 8*a* at the bottom side 9 and a planar face 2*a* of the slider 2, disposed opposite to this bottom side 9. The matrix print head 1 and the slider 2 are connected to each other in this area of the oppositely disposed planar faces 8*a* or 2*a*, respectively, i.e. they are somewhat yieldingly braced and/or clamped. The rail guide 3 can in this case be considered as a whole or subdivided into a guide axle support 11 of circular cross-section and an axle 12 of rectangular cross-section.

As represented, the sound-insulating layer 10 is disposed in the area of the inner hollow print pin guide casing 13 of the matrix print head 1.

Figure 2:
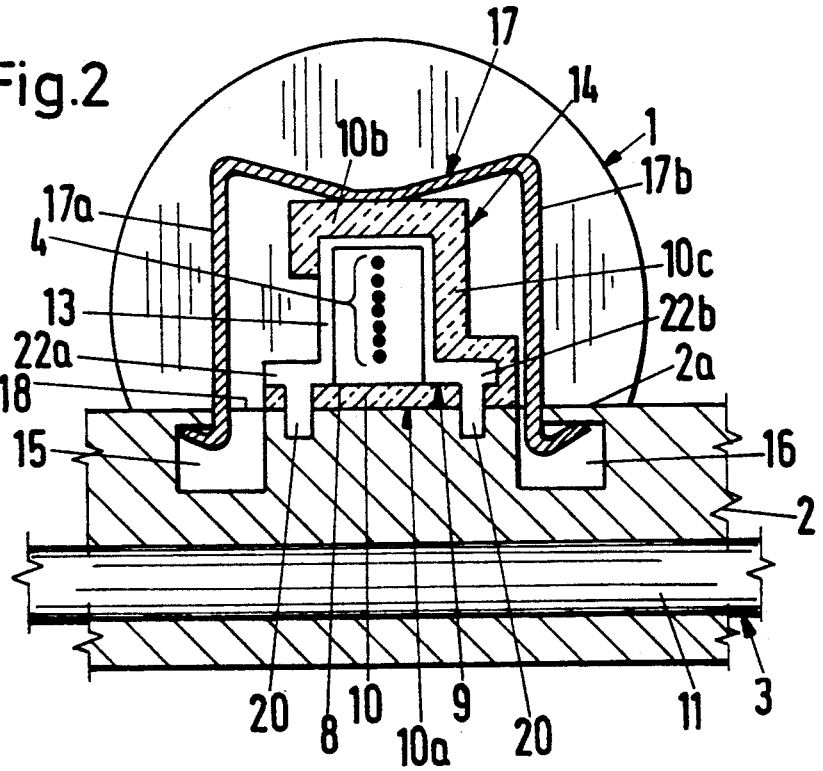
FIG. 2 is a cross-section through the print head and the slider according to section line II—II of FIG. 1.

The sound-insulating layer 10, illustrated in FIG. 2, is part of a single-piece packing body 14 fully surrounding the pin print guide casing 13 of the matrix print head 1 on at least three sides, in particular the bottom side 10*a*, the top side 10*b*, and the side wall 10*c*. The packing body 14 as a whole is illustrated in detail in FIG. 3 and is described in more detail below.

The print pin guide casing 13 of the matrix print head 1 is furthermore braced and clamped with a spring clamp 17 on the slider 2, where the spring clamp 17 grips below recesses 15 and 16 of the slider 2. The spring arms 17*a* and 17*b* can be pressed easily in inward direction by the operating personnel such that a spring arm 17*a* can be pulled upwardly through the opening 18, can be swivelled around the packing body 14 or the print pin guide casing 13, respectively, and the matrix print head 1 can be removed.

The best solution in connection with a pin matrix print head 1 is if the reference face 8 between the matrix print head 1 and the slider 2 is disposed immediately neighboring, as illustrated in FIG. 1, at a guide mouth piece 19 of the pin guide casing 13.

Figure 3:
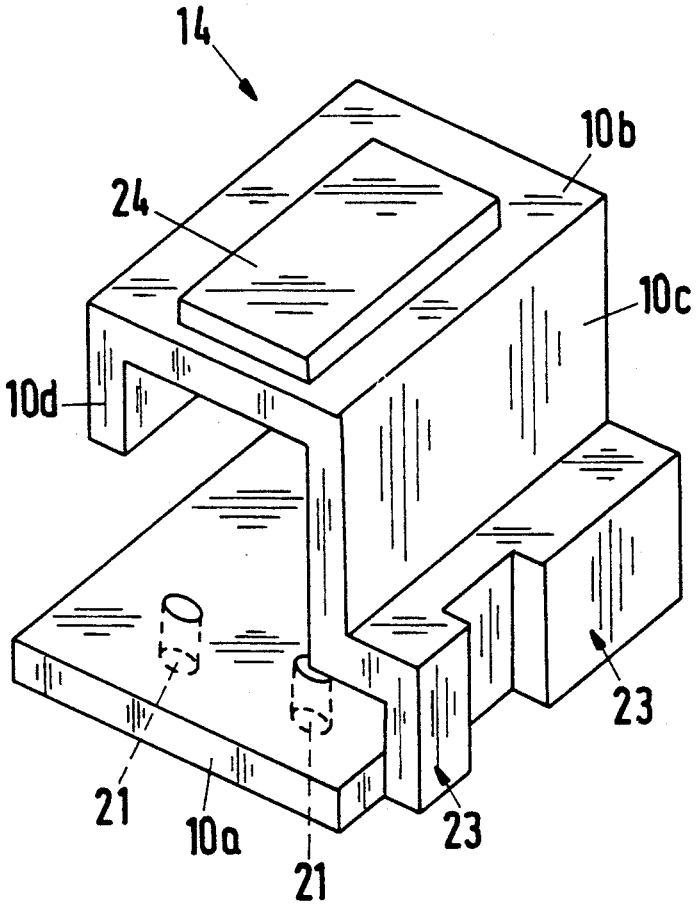
FIG. 3 is a perspective view of the packing body.

The packing body 14 is illustrated in more detail in FIG. 3. The packing body 14 is furnished with a planar bottom side 10*a*. This planar bottom side 10*a* closes the print pin guide casing 13. Positioning protrusions 20 are furnished at the print pin guide casing 13. These positioning protrusions 20 penetrate openings 21 of the packing body 14. In this situation, the reference face 8 or the planar face 8*a*, respectively, at the bottom side 9 of the matrix print head 1 are formed by two support webs 22*a*, 22*b*. The support webs 22*a* and 22*b* furnish an extension of the reference face 8 of the print head to furnish an improved attachment on the slider via an extended reference face. The extensions or support webs 22*a*, 22*b* can be from about 0.2 to 0.8 times the width of the print pin guide casing and are preferably 0.4 to 0.5 times the width of the print pin guide casing. The support webs 22*a*, 22*b* can be further formed as a heat sink for the print pin guide casing by having a thickness of from 1.5 to 3 times the wall thickness of the print pin guide casing.

A cross-sectional region 23 of the packing body 14 surrounds one of the support webs 22*b* of the print pin guide casing 13, on one side. A packing body part 24 is attached to the top of the top side 10*b* and surrounds in part the U-cross-section, illustrated in FIG. 2, of the pin guide casing 13 and which covers the top side 10*b*. The packing body 14 can be flipped around the cross-sectional region 23 enclosing the support web 22*b* like a hinge. The packing body part 24 additionally serves, based on its thickness and shape, for balancing the elasticity of the packing body 14 formed, for example, of rubber. An additional, shortened side wall part 10*d* of the packing body 14 correspondingly surrounds the pin print guide casing 13. The side wall part 10*d* is preferably attached to the top side 10*b* to furnish a better clamping of the upper half of the print pin guide casing.

The sound-insulating material can be made as porous intermediate layers or as rubber buffers. The sound absorbing material can be furnished by attached layers and coatings.

The clamp 17 is preferably shaped like a U, where the rounded section of the U is furnished with a central curved section of opposite curvature direction. The curvature of the U in the center can be small and the radius of curvature can be large to provide a good clamping force transfer from the clamp 17 to the packing body part 24 and to the top side 10*b* of the packing body 14.

The clamp 17 can be formed as a metal strip made of spring steel or spring bronze. Preferably, the straight side sections of the U run parallel to the print pin guide casing side walls or to the line sequence of the print pin positions near the position of a substrate support. The overall configuration of the U approaches preferably a square when considering the three main sections of the U. The U is furnished at the two end points with bent sections disposed toward the outside of the U, where the bending angle is at least about 95 degrees and preferably at least about 110 degrees. The width of the metal strip forming the clamp 17 can be about 0.2 to 0.5 times the extension of the sound attenuating layer in a direction parallel to the width of the metal strip.

It will be understood that each of the elements described above, or two or more together, may also find a useful application in other types of printers differing from the types described above.

While the invention has been illustrated and described as embodied in the context of a matrix printer with a matrix print head, in particular with a matrix pin print head, where the print head is supported on a back and forth movable slider, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A matrix printer comprising a print substrate support for supporting an imprint-receiving substrate resting on the print substrate support;

a back and forth movable slider;

a matrix print head supported by the slider, fixable in its position relative to the slider, and including print elements, movable relative to the direction of the substrate support for impacting an inked ribbon;

a rail guide support guiding and supporting the matrix print head;

a sound-insulating layer of an elastic material furnished too the matrix print head and placed at least against one outer reference face between the matrix print head and the slider; clamping means including a spring clamp for bracing and clamping the matrix print head and the slider to each other in a region of the sound-insulating layer;

a recess provided in the slider wherein;

said spring clamp, clamps the print pin guide casing of the matrix spring head onto the slider, and grips lockingly within said recess of the slider for retaining the matrix print head on the slider in a fixed position.

2. The matrix printer according to claim 1, wherein the print elements are operated at a frequency higher than 1000 Hz.

3. The matrix printer according to claim 1, wherein the matrix print head is a matrix pin print head.

4. The matrix printer according to claim 1 further comprising a second recess disposed on the slider, wherein the spring clamp grips lodingly within said second recess.

5. The matrix printer according to claim 1, further comprising a print pin guide casing for the matrix print head, wherein the sound-insulating layer extends over and surrounds the print pin guide casing of the matrix print head.

6. The matrix printer according to claim 5, wherein the sound-insulating layer is furnished by a single-piece packing body surrounding the print pin guide casing of the matrix print head on at least three sides, including a bottom side, a top side, and a side wall.

7. The matrix printer according to claim 5, wherein the print pin guide casing is furnished with a guide mouth piece, and wherein the reference face between the matrix print head and the slider is disposed immediately neighboring at the guide mouth piece of the print pin guide casing.

8. The matrix printer according to claim 5 further comprising a packing body having a planar bottom face and closing with its planar bottom face the print pin guide casing of the matrix print head and including a cross-sectional hinge region;

a support web attached to the print pin guide casing; positioning protrusions furnished at the print pin guide casing, wherein the cross-sectional hinge region of the packing body surrounds on one side a support web of the print pin guide casing;

a packing body part partially surrounding a U-shaped section of the print pin guide casing and covering part of a top side and connected to the cross-sectional hinge region of the packing body, and wherein openings are furnished in the packing body for the positioning protrusions of the matrix print head.

9. The matrix printer according to claim 8 wherein the spring clamp lockingly engages the slider and surrounding the print pin guide casing for retaining the matrix print head againsts the slider.

10. The matrix printer according to claim 9, wherein the spring clamp engages recesses of the slider disposed on two opposite sides relative to the reference face between matrix print head and slider.

11. The matrix printer according to claim 9, wherein the spring clamp is formed of a spring strip pressing the matrix print head against the slider.

12. A matrix printer with a matrix print head, in particular a matrix pin spring head;

a back and forth movable slider supporting the matrix print head, where the slider is guided on a rail guide support, wherein print elements are operated at a frequency higher than 1000 Hz, and wherein the print elements are movable against an imprint-receiving substrate resting on a spring substrate support with an inking ribbon disposed between the matrix print head and the print substrate support, wherein the matrix print head (1), fixable in its position relative to the slider (2), is furnished with a sound-insulating layer (10) of an elastic material at least at a reference face (8) between the matrix print head (1) and the slider (2);

a recess disposed in the slider a spring clamp gripping under the recess of the slider (2) and bracing the matrix print head (1) and the slider (2) to each other in a region of the sound-insulating layer (10).

13. The matrix printer according to claim 12, wherein the reference face (8) between the matrix print head (1) and the slider (2) is disposed immediately neighboring at a guide mouth piece (19) of the pin guide casing (13).

14. The matrix printer according to claim 12 further comprising a second recess disposed in the slider, wherein the spring clamp further grips under the second recess.

15. The matrix printer according to claim 12, wherein the sound-insulating layer (10) extends over and surrounds a print pin guide casing (13) of the matrix print head (1) wherein the print pin guide casing (13) exhibits a U-shape in a cross-section.

16. The matrix printer according to claim 15, wherein the sound-insulating layer (10) forms part of a single-piece packing body (14) surrounding the print pin guide casing (13) of the matrix print head (1) on at least three sides and including bottom side (10*a*), top side (10*b*), and side wall (10*c*).

17. The matrix printer according to claim 16, further comprising a support web (22*a*, 22*b*) attached to the print pin guide casing (13), wherein the planar bottom side (10*a*) of the packing body (14) closes the print pin guide casing (13) of the matrix print head (1) furnished with positioning protrusions (20), wherein a cross-sectional hinge region (23) of the packing body (14) surrounds on one side the support web (22*a*, 22*b*) of the print pin guide casing (13), wherein a packing body part (24), partially surrounding a U-shaped section of the print pin guide casing (13), and covering part of the top side (10*b*), is connected to the cross-sectional hinge region (23) of the packing body (14), and wherein openings (21) are furnished for the positioning protrusions (20) of the matrix print head (1).

18. A method for fixedly attaching a matrix print head to a slider comprising providing a back and forth movable slider with a recess for engagement by a clamp;

providing a spring clamp for holding a print head and for engaging the recess of the slider;

guiding and supporting a back and forth movable slider on a rail guide support;

placing a sound-insulating layer of an elastic material around a matrix print head for positioning the matrix print head with at least an outer reference face between the matrix print head and the slider;

placing an imprint-receiving substrate against a print substrate support;

clamping the matrix print head, including movable print elements relative to a direction of the substrate support for impacting an inked ribbon, together with the second-insulating layer to the slider with the spring clamp engaging the recess of the slider for fixing a position of the matrix print head relative to the slider by attaching the matrix print head to the slider through a region of the sound-insulating layer.

19. The matrix printer according to claim 18 further comprising providing a second recess on the slider;

engaging the second recess with the clamp spring thereby allowing disengagement of the spring clamp at two places.

20. A matrix printer comprising a print substrate support for supporting an imprint-receiving substrate resting on the print substrate support;

a back and forth movable slider;

a matrix print head supported by the slider, fixable in its position relative to the slider, and including print elements, movable relative to the direction of the substrate support for impacting an inked ribbon;

a rail guide support guiding and supporting the matrix print head;

a sound-insulating layer of an elastic material furnished to the matrix print head and placed at least against one outer reference face between the matrix print head and the slider; clamping means for bracing and clamping the matrix print head and the slider to each other in the region of the sound-insulating layer, wherein the print elements are operated at a frequency higher than 1000 Hz, and wherein the matrix print head is a matrix pin print head;

further comprising a print pin guide casing for the matrix print head, wherein the sound-insulating layer extends over and surrounds the print pin guide casing of the matrix print head, wherein the sound-insulating layer is furnished by a single-piece packing body surrounding the print pin guide casing of the matrix print head on at least three sides, including a bottom side, a top side, and a side wall;

a spring clamp, clamping the print pin guide casing of the matrix print head onto the slider, and gripping lockingly under recesses of the slider for retaining the matrix print head on the slider in a fixed position;

a packing body having a planar bottom face and closing with its planar bottom face the print pin guide casing of the matrix print head and including a cross-sectional hinge region;

a support web attached to the print pin guide casing;

positioning protrusions furnished at the print pin guide casing, wherein the cross-sectional hinge region of the packing body surrounds on one side a support web of the print pin guide casing;

a packing body part partially surrounding a U-cross-section of the print pin guide casing and covering part of a top side and connected to the cross-sectional hinge region of the packing body, and wherein openings are furnished in the packing body for the positioning protrusions of the matrix print head.

* * * * *